US011084081B2

(12) United States Patent
Lin

(10) Patent No.: US 11,084,081 B2
(45) Date of Patent: Aug. 10, 2021

(54) PUNCHING MOLD DEVICE CAPABLE OF ROTATING A WORKPIECE AND PUNCHING METHOD USING THEREOF

(71) Applicant: Quanta Computer Inc., Taoyuan (TW)

(72) Inventor: Shu-Chen Lin, Taoyuan (TW)

(73) Assignee: Quanta Computer Inc., Taoyuan (TW)

( * ) Notice: Subject to any disclaimer, the term of this patent is extended or adjusted under 35 U.S.C. 154(b) by 399 days.

(21) Appl. No.: 16/163,056

(22) Filed: Oct. 17, 2018

(65) Prior Publication Data

US 2019/0374993 A1 Dec. 12, 2019

(30) Foreign Application Priority Data

Jun. 12, 2018 (TW) ..... 107120235

(51) Int. Cl.
*B21D 28/28* (2006.01)
*B21D 28/36* (2006.01)
(Continued)

(52) U.S. Cl.
CPC ..... *B21D 28/28* (2013.01); *B21D 28/36* (2013.01); *B21D 37/06* (2013.01); *B21D 43/003* (2013.01); *B21D 43/02* (2013.01)

(58) Field of Classification Search
CPC ..... B21D 28/28; B21D 28/36; B21D 28/34; B21D 28/30; B21D 28/24; B21D 37/06;
(Continued)

(56) References Cited

U.S. PATENT DOCUMENTS 3,371,514 A * 3/1968 Venables, III ..... B21D 43/003 72/421
5,263,237 A * 11/1993 Gallant ..... B21D 28/12 29/402.06
(Continued)

FOREIGN PATENT DOCUMENTS

CN 201848477 U * 6/2011
CN 103264089 A 8/2013
(Continued)

OTHER PUBLICATIONS

Zhuping, Tian , et al., "Die Design for the Pedestal Side Panel of Water Pump", Die and Mould Technology, May 15, 1999, p. 29-32.

*Primary Examiner* — Teresa M Ekiert
*Assistant Examiner* — Sarkis A Aktavoukian

(57) ABSTRACT

A punching mold device capable of rotating a workpiece includes an upper mold base, a lower mold base opposite to the lower mold base, an indexing rotation plate, a servo motor and a position-fixing element. The lower mold base includes a clamping portion for fixedly clamping a workpiece. The indexing rotation plate is formed with holes which collectively form a circular contour. The servo motor is connected to the indexing rotation plate and the workpiece, and synchronously rotates the indexing rotation plate and the workpiece. The position-fixing element includes a positioning pin which aims towards and is pluggably connected to one of the holes for stopping the rotation of the indexing rotation plate and the workpiece. The upper mold base includes a punching head module aligned with the clamping portion for punching the workpiece.

12 Claims, 9 Drawing Sheets

(51) Int. Cl.
*B21D 43/02* (2006.01)
*B21D 43/00* (2006.01)
*B21D 37/06* (2006.01)

(58) Field of Classification Search
CPC ..... B21D 37/12; B21D 43/003; B21D 43/02; B21D 22/08
See application file for complete search history.

(56) References Cited

U.S. PATENT DOCUMENTS

2010/0083803 A1* 4/2010 Sanderson ..... B26F 1/0061 83/36
2013/0008001 A1* 1/2013 Long ..... B23P 19/12 29/56.6

FOREIGN PATENT DOCUMENTS

CN 105363885 A * 3/2016
CN 105414322 A * 3/2016
CN 105414322 A 3/2016
CN 205463855 U * 8/2016
GB 646151 A * 11/1950

* cited by examiner

PUNCHING MOLD DEVICE CAPABLE OF ROTATING A WORKPIECE AND PUNCHING METHOD USING THEREOF

RELATED APPLICATIONS

This application claims priority to Taiwan Application Serial Number 107120235, filed Jun. 12, 2018, which is herein incorporated by reference.

BACKGROUND

Field of Disclosure

The present disclosure relates to a punching mold device. More particularly, the present disclosure relates to a punching mold device capable of rotating a workpiece and a punching method using the punching mold device.

Description of Related Art

In general, stamping is a forming process exerting external forces on a workpiece (such as sheets, strips, tubes and profiles etc.) to deform or separate the workpiece (e.g., to cut, bend or pierce the workpiece) by using a pressing machine and a mold cooperatively, thereby obtaining the workpiece with a desired shape and size.

In a conventional stamping die, if a punching operation with multiple angles from 0 to 360 degrees is desired to be performed on a circumferential surface of a cylindrical workpiece, the punching operation has to be divided into a variety of task stations for completing the entire punching operation. Thus, the punching not only becomes complicated, but also causes use inconvenience to the operator. Moreover, while in production, the above-mentioned conventional task stations need to replace different punching machines respectively for performing the complicated process, thus not only resulting in low positioning accuracy of the cylindrical workpiece, but also causing low production efficiency due to cumulative errors, increasing cost, failing to ensure the product quality.

As such, how to effectively improve the aforementioned shortages and disadvantages is seriously concerned by those who are skilled in the art.

SUMMARY

In one embodiment of the present disclosure, a punching mold device capable of rotating a workpiece includes an upper mold base, a lower mold base, an indexing rotation plate, a servo motor and a position-fixing element. The lower mold base includes a clamping portion for fixedly clamping the workpiece. The indexing rotation plate is formed with plural holes which collectively form a circular contour. The indexing rotation plate is coaxial to the workpiece. The servo motor is a power source for synchronously rotating the indexing rotation plate and the workpiece. The position-fixing element is controlled by, for example, a solenoid valve or a rotary encoder, so as to perform indexing, rotating and positioning of an indexing plate. Moreover, a positioning pin of the indexing positioning member aims towards one of the holes, and is pluggably connected to the hole for stopping the rotation of the indexing rotation plate and the workpiece. The upper mold base is disposed opposite to the lower mold base. The upper mold base includes a punching head module aligned with the clamping portion for punching the workpiece.

In one embodiment of the present disclosure, a punching mold device capable of rotating a workpiece includes a clamping portion, an indexing rotation plate, a servo motor, a position-fixing element, a solenoid valve unit, a punching head module, a dynamic device and a central control unit. The clamping portion is used to fixedly clamp the workpiece. The indexing rotation plate is coaxial with the workpiece and is formed with plural holes collectively form a circular contour. The servo motor is connected to the indexing rotation plate and the workpiece for synchronously rotating the indexing rotation plate and the workpiece. The position-fixing element includes a positioning pin which is pluggably connected to one of the holes for stopping the rotation of the indexing rotation plate and the workpiece. The solenoid valve unit is connected to the positioning pin for reciprocating the positioning pin. The punching head module is aligned with the clamping portion. The dynamic device is connected to the punching head module. The central control unit electrically connected to the dynamic device, the servo motor and the solenoid valve unit. For example, the central control unit is connected to the punching head module and the indexing rotation plate for indexing and positioning for 360-degree punching.

Thus, when the central control unit controls the servo motor to synchronously rotate the indexing rotation plate and the workpiece, (a) the central control unit controls the solenoid valve unit to insert the positioning pin into one of the holes; (b) the central control unit controls the dynamic device to drive the punching head module to punch the workpiece that is stopped from rotating; (c) the central control unit controls the solenoid valve unit to remove the positioning pin away from the one of the holes so as to allow the indexing rotation plate and the workpiece to be rotatable again, (d) repeating the steps (a), (b) and (c) until the workpiece is completed.

In the present disclosure above, the aforementioned punching mold device may also be operated with different types of indexing rotation plates. The indexing rotation plates are divided into a hole-type indexing plate and a digital indexing plate according to different indexing positioning dials. The hole-type indexing plate is formed with plural holes, and the holes are collectively arranged in a circular contour. The solenoid valve unit controls the positioning pin to be inserted into or unplugged from the selected hole so as to complete the rotation or indexing of the indexing rotation plate. Programs for controlling the continuous motion of the solenoid valve unit can be written with a certain delay action, a release action, a rotation action, a lock action, and a return action. The digital indexing plate uses a rotary encoder as the indexing rotation plate in which a light source and a grating (e.g., a photo sensor array) are respectively arranged on both sides of the indexing rotation plate, and data read by the photo sensor can indicate the rotation position of the indexing rotation plate and is generally transferred to a microprocessor and converted to the position of the axis, such that the digital indexing plate is connected to the central control unit.

Thus, in the structures of the aforementioned embodiments, the present disclosure provides a continuous punching mold device which is implemented on simultaneous punching processes so as to solve the bottleneck problem that the same workpiece cannot be punched from different directions (all directions in 360 degrees) with the same punching machine. In addition, by installing an indexing rotation plate that is able to rotate synchronously along with the workpiece, the rotation angle of the workpiece can be precisely controlled, thereby ensuring that a suitable stamping process can be performed onto the circumferential surface of the workpiece to further complete a product in sequence, thus effectively increasing and improving the productivity.

The above description is merely used for illustrating the problems to be resolved, the technical methods for resolving the problems and their efficacies, etc. The specific details of the present disclosure will be explained in the embodiments below and related drawings.

BRIEF DESCRIPTION OF THE DRAWINGS

The accompanying drawings are included to provide a further understanding of the present disclosure, and are incorporated in and constitute a part of this specification. The drawings illustrate embodiments of the present disclosure and, together with the description, serve to explain the principles of the present disclosure. In the drawings.

DESCRIPTION OF THE EMBODIMENTS

Figure 1:
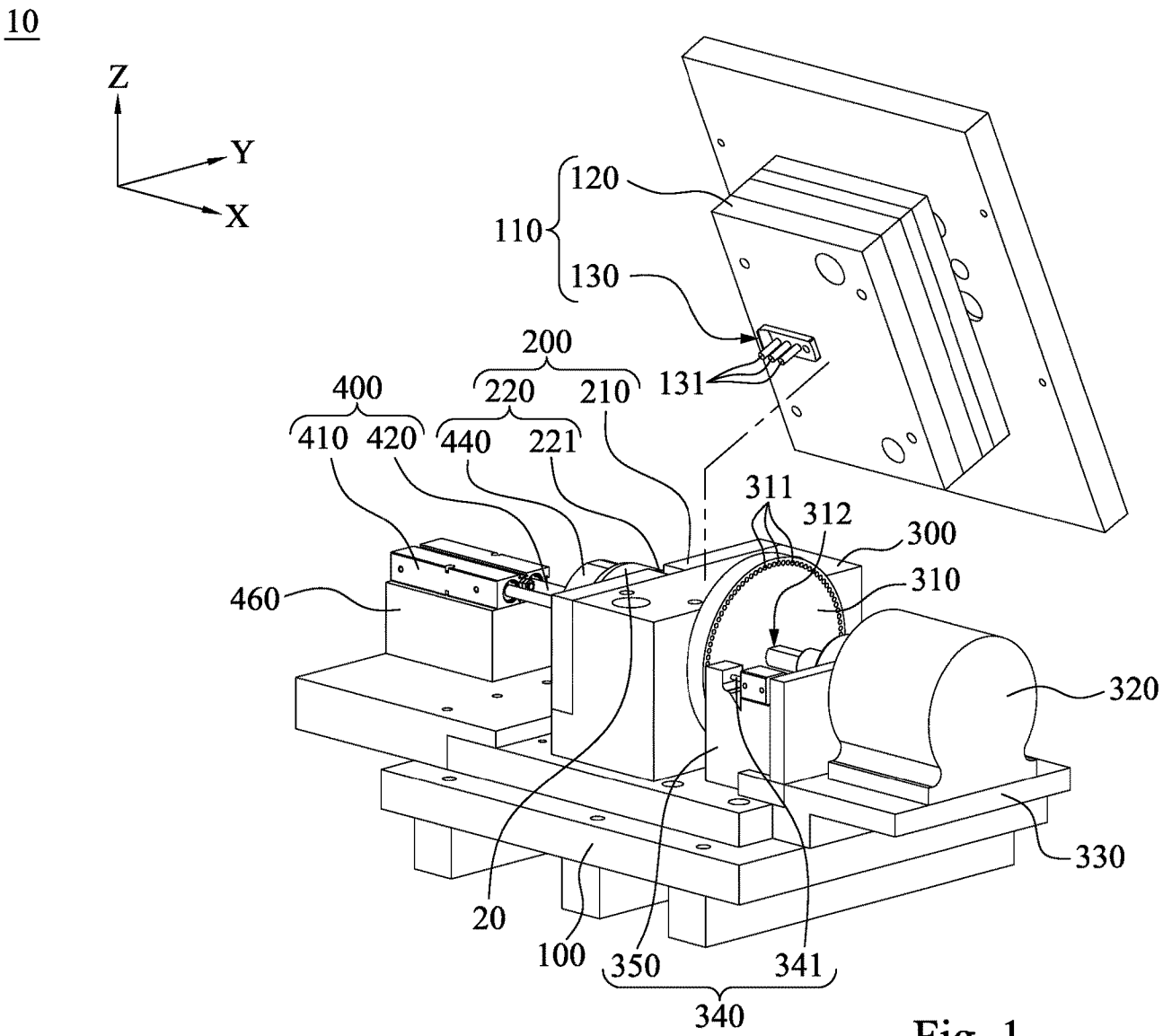
FIG. 1 is a perspective view of a punching mold device according to one embodiment of the present disclosure.

Reference will now be made in detail to the present embodiments of the present disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the present disclosure without departing from the scope or spirit of the present disclosure.

Figure 2A:
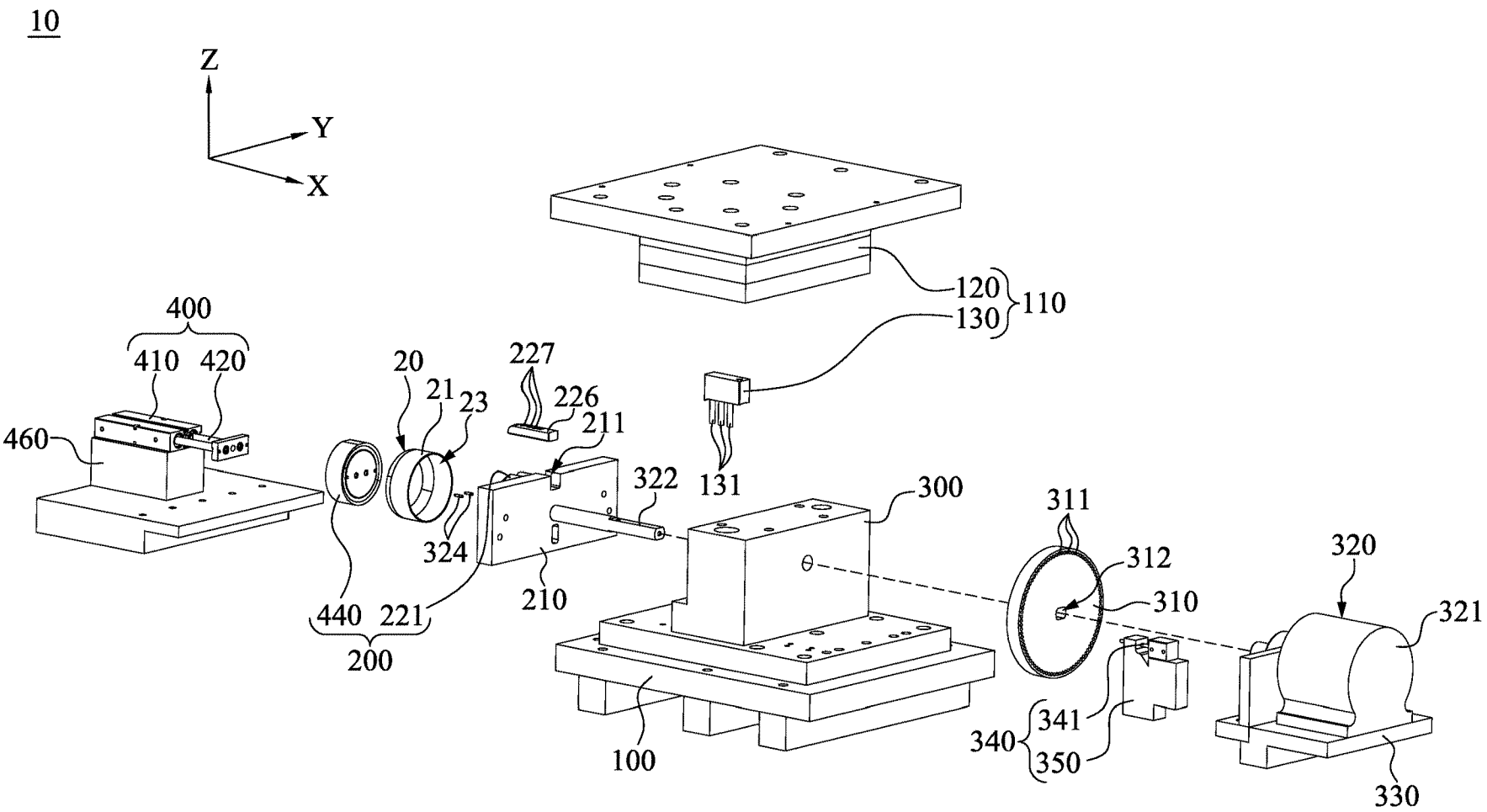
FIG. 2A is an exploded view of the punching mold device of FIG. 1.
Figure 2B:
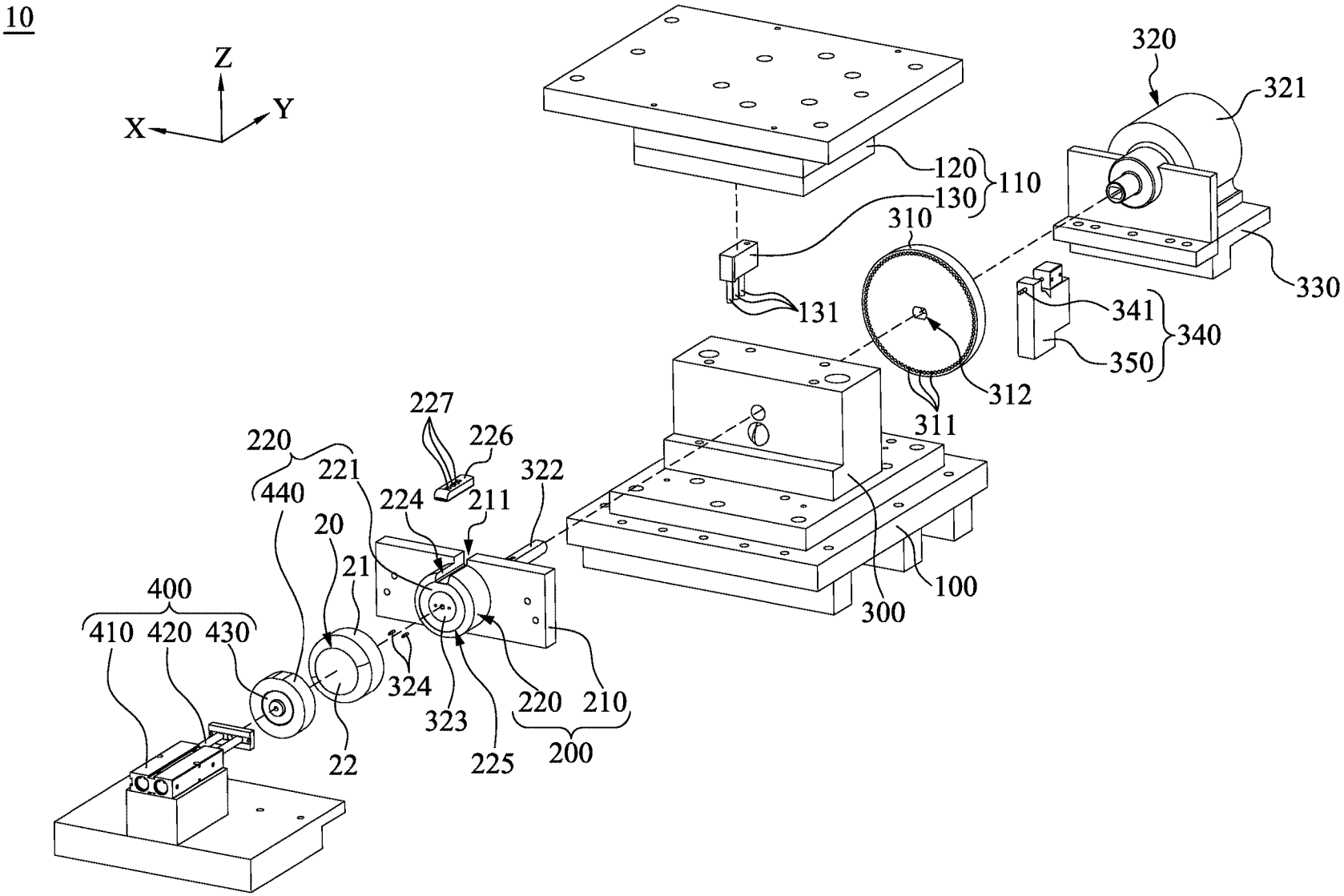
FIG. 2B is an exploded view of the punching mold device of FIG. 1 viewed from another view angle.

Reference is now made to FIG. 1 to FIG. 2B, in which FIG. 1 is a perspective view of a punching mold device 10 according to one embodiment of the present disclosure, FIG. 2A is an exploded view of the punching mold device 10 of FIG. 1, and FIG. 2B is an exploded view of the punching mold device 10 of FIG. 1 viewed from another view angle. As shown in FIG. 1, FIG. 2A and FIG. 2B, the punching mold device 10 includes a baseplate 100, an upper mold base 110, a lower mold base 200, an indexing plate stand 300, an indexing rotation plate 310, a servo motor 320, a motor seat 330 and a position-fixing element 340. The position-fixing element 340 has a fixing base 350 and a positioning pin 341. The indexing plate stand 300, the fixing base 350 and the servo motor 320 are located on the baseplate 100. The servo motor 320 is placed on the motor seat 330. The positioning pin 341 is located on the fixing base 350. The positioning pin 341 can be controlled by a solenoid valve to perform a forward/return action for releasing/locking the indexing rotation plate 310 while rotating/stopping the workpiece 20. The lower mold base 200 is disposed on one side of the indexing plate stand 300, and the indexing rotation plate 310 is disposed on the opposite side of the indexing plate stand 300. That is, the indexing plate stand 300 is disposed between the lower mold base 200 and the indexing rotation plate 310. The lower mold base 200 includes a stationary mold 210 and a clamping portion 220. The clamping portion 220 is disposed on one surface of the stationary mold 210 opposite to the indexing rotation plate 310. The clamping portion 220 is used to fixedly clamp a workpiece which is required to be punched. The clamping portion 220 includes a mandrel 440 and a protrusion body 221. The mandrel 440 is movable to press against the workpiece 20. The protrusion body 221 is opposite to the mandrel 440, and is used to allow the workpiece 20 to be placed thereon. For example but not to limit the type of workpiece, the workpiece 20 is a round column cover, and one surface of the workpiece 20 is concavely formed with a depression portion 23, such that the workpiece 20 can be hung on the protrusion body 221 of the lower mold base 200 once the protrusion body 221 extends into the depression portion 23 of the workpiece 20.

The indexing rotation plate 310 is formed with holes 311. The holes 311 collectively form a circular contour surrounding an axis line of the indexing rotation plate 310, that is, the axis line of the indexing rotation plate 310 is a center point of the circular contour, and the axis line of the indexing rotation plate 310 extends in an axial direction (e.g., X axis).

For example, linear distances between each of the holes 311 and the axis line of the indexing rotation plate 310 are the same. The servo motor 320 is connected to the indexing rotation plate 310 and the aforementioned workpiece 20, and configured to rotate the indexing dial 310 and the workpiece 20 synchronously, and the workpiece 20 can be rotated relative to the protrusion body 221. The positioning pin 341 is disposed on one side of the indexing rotation plate 310, the positioning pin 341 exactly aims towards one of the holes 311, and the positioning pin 341 is pluggably connected to the aimed hole 311. Thus, after the positioning pin 341 is inserted into the hole 311, the positioning pin 341 can stop the rotation of the indexing rotation plate 310 and the workpiece 20. In the embodiment, after the positioning pin 341 is inserted and unplugged from all of the holes 311 sequentially, the indexing rotation plate 310 are rotated a full turn along with the workpiece 20. However, the present disclosure is not limited thereto. When the indexing rotation plate 310 is rotated, the positioning pin 341 may also skip a certain number of the holes 311 before being inserted into another hole 311 again, thereby adjusting degrees of the rotation of the indexing rotation plate 310.

The upper mold base 110 is disposed oppositely to the lower mold base 200, and is movably disposed on one side of the lower mold base 200. The upper mold base 110 includes a pressing board 120 and a punching head module 130. The punching head module 130 is located on one surface of the pressing board 120 facing towards the lower mold base 200, and the punching head module 130 is aligned with the protrusion body 221 of the clamping portion 220 for punching one part of a peripheral surface (e.g., the circumferential surface 21 of the round column cover) of the workpiece 20. Thus, each time when the indexing rotation plate 310 is stopped by the positioning pin 341, the punching head module 130 punches the peripheral surface of the workpiece 20 (for example, the circumferential surface 21 of the round column cover). In other words, when the number of the holes 311 is N (i.e., N is a positive integer), whenever the indexing rotation plate 310 is rotated by 360/N degrees each time, the punching head module 130 punches the corresponding area of the workpiece 20 once. However, the present disclosure is not limited thereto, and one skilled in the art is able to adjust the indexing format and spans of the indexing rotation plate 310 according to requirements or limitations.

Thus, since the servo motor 320 rotates the workpiece 20 synchronously, the punching head module 130 of the upper mold base 110 is able to sequentially press the entire region around the peripheral surface of the workpiece 20 (for example, the circumferential surface 21 of the round column cover). The bottleneck problem that the same workpiece cannot be punched from different directions (all directions in 360 degrees) with the same punching machine can be solved. Furthermore, by installing an indexing rotation plate 310 that is able to rotate synchronously along with the workpiece 20, the rotation angle of the workpiece 20 can be precisely controlled, such that the density variation of all punched holes 24 formed by the punching on the peripheral surface of the workpiece 20 can be precisely controlled, thereby ensuring that a suitable stamping process can be performed on the circumferential surface of the workpiece 20, thus further completing a product in sequence, and effectively increasing and improving the productivity.

Figure 3:
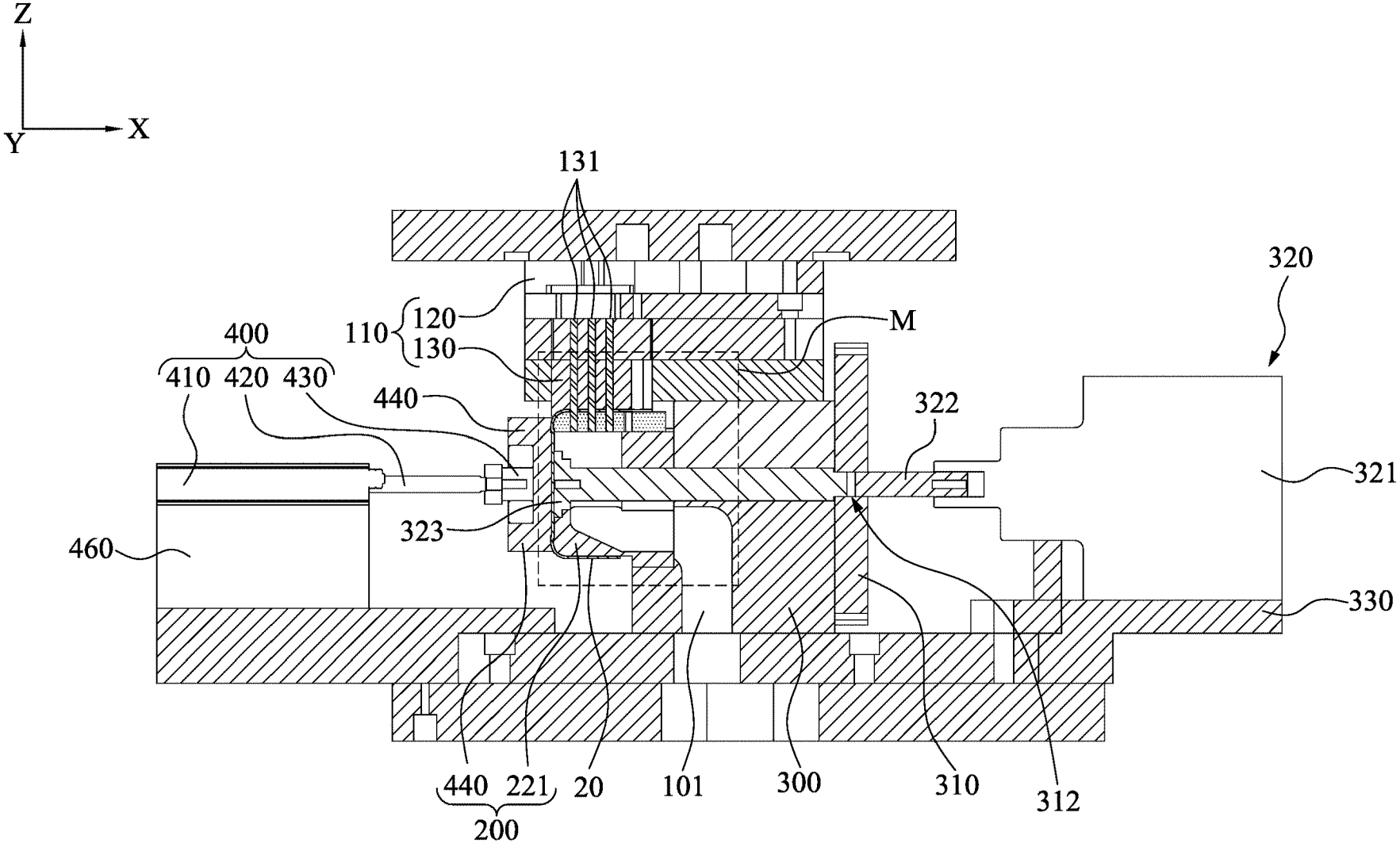
FIG. 3 is a longitudinal cross-sectional view of the punching mold device of FIG. 1.

FIG. 3 is a longitudinal section view of the punching mold device of FIG. 1. As shown in FIG. 2A and FIG. 3, the servo motor 320 includes a motor machine 321, a transmission shaft 322 and a workpiece chuck 323. The transmission shaft 322 extends along an axial direction (e.g., X axis). One end of the transmission shaft 322 is connected to the motor machine 321. For example, one end of the transmission shaft 322 is fixedly connected to the motor machine 321. The other end of the transmission shaft 322 is connected to the workpiece chuck 323. For example, the other end of the transmission shaft 322 is monolithically connected to the workpiece chuck 323. The transmission shaft 322 passes through the indexing rotation plate 310, the indexing plate stand 300, the stationary mold 210 and the protrusion body 221 of the clamping portion 220 sequentially. The workpiece chuck 323 passes through an opening 225 of the protrusion body 221 to directly resist the inner wall of the workpiece 20 in the depression portion 23 of the workpiece 20, so as to rotate together with the workpiece 20. The motor machine 321 can synchronously rotate the indexing rotation plate 310 and the workpiece 20 through the transmission shaft 322. Therefore, the indexing rotation plate 310 and the workpiece 20 are coaxial with each other.

Furthermore, the indexing rotation plate 310 is formed with a non-circular through hole 312 on the axis line of the indexing rotation plate 310. The transmission shaft 322 fitly passes through the non-circular through hole 312 of the indexing rotation plate 310, so as to rotate the indexing rotation plate 310, that is, the indexing rotation plate 310 can rotate with the drive shaft 322.

Also, the punching mold device 10 further includes a positioning cylinder 400. The mandrel 440 is connected to the positioning cylinder 400. The positioning cylinder 400 can push the mandrel 440 towards a surface (i.e., top surface 22) of the workpiece 20 opposite to the indexing rotation plate 310, such that the mandrel 440 directly contacts and presses against the workpiece 20, so as to be rotated synchronously with the workpiece 20. That is, the workpiece 20 is firmly sandwiched between the protrusion body 221 and the mandrel 440 so as to reduce the vibration generated on the workpiece 20 during the punching process. The mandrel 440 is, such as silica gel, rubber or another similar material with high shock absorption, but the present disclosure is not limited thereto.

In the embodiment, the positioning cylinder 400 includes a cylinder body 410 and a telescoping arm 420. The cylinder body 410 is disposed on a cylinder base 460. The telescoping arm 420 is telescopically connected the cylinder body 410. The mandrel 440 is rotatably jointed to the telescoping arm 420. When the cylinder body 410 pushes the telescoping arm 420 forwardly in an axial direction (e.g., X-axis), the mandrel 440 directly contacts and presses against the top surface 22 of the workpiece 20, so as to be rotated synchronously with the workpiece 20. More specifically, one distal end of the telescoping arm 420 located away from the cylinder body 410 further includes a rotating portion 430. The rotating portion 430 is rotatably connected to the telescoping arm 420. The mandrel 440 is rotatably jointed to the rotating portion 430. Therefore, the mandrel 440 can be rotated with the rotating portion 430 relative to the telescoping arm 420. In other words, the mandrel 440 is able to rotate the workpiece 20 with the transmission shaft 322 synchronously. For example, the rotating portion 430 is, a ball bearing, but the present disclosure is not limited thereto.

However, it is noted that, as long as one end (on which such as a suction cup, a magnet or an inflation air bag is disposed) of the servo motor can directly hold the workpiece firmly, other embodiments of the present disclosure may omit the aforementioned mandrel and are limited to holding of the workpiece in the clamping way.

Figure 4:
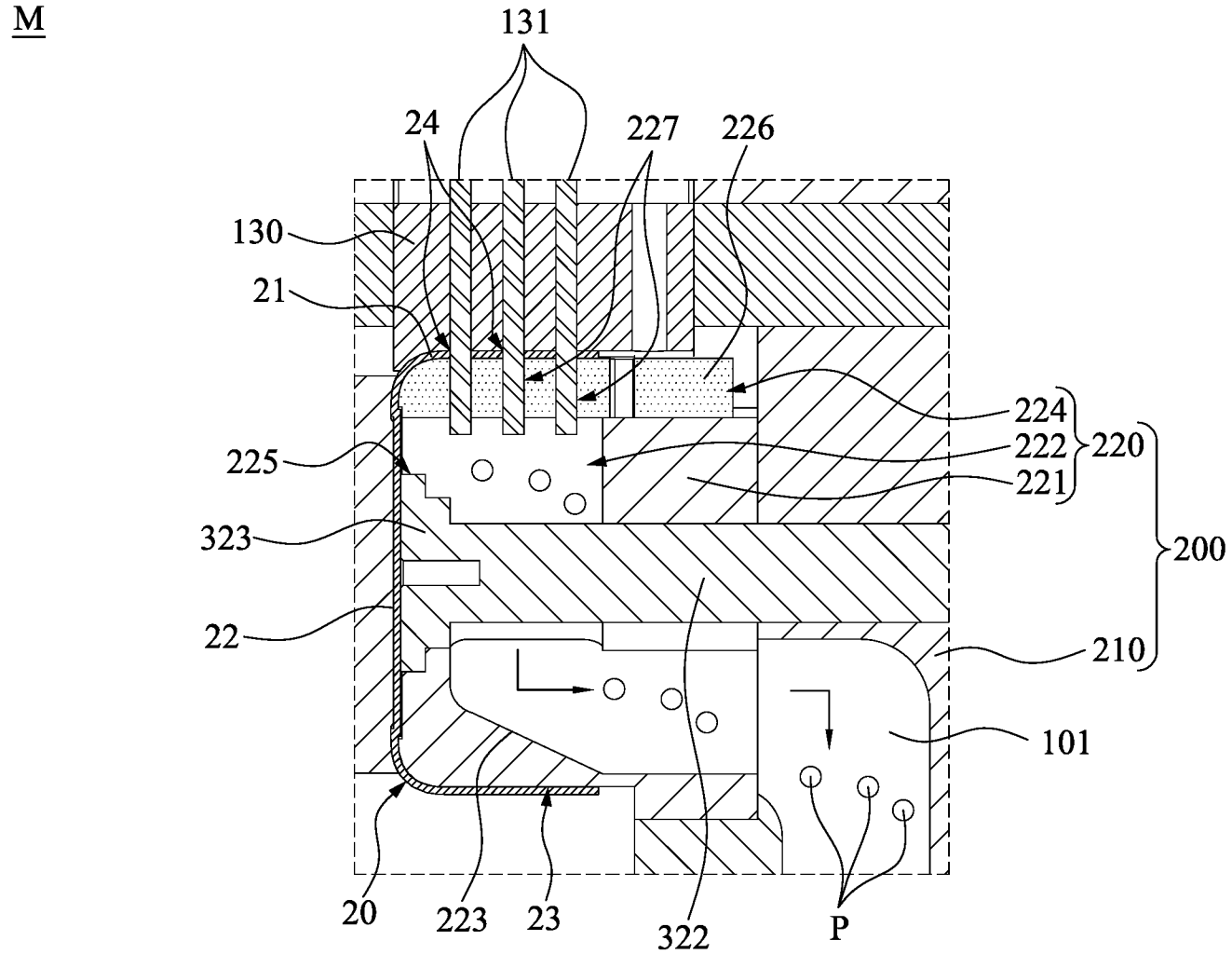
FIG. 4 is an schematic view showing an area M of the punching mold device of FIG. 3 that is in operation.

FIG. 4 is a schematic view of an area M of the punching mold device 10 of FIG. 3 while in operation. As shown in FIG. 3 and FIG. 4, the clamping portion 220 further includes a discharge zone passage 222, a residue entrance 224 and an air passage 101. The discharge zone passage 222 is disposed inside the protrusion body 221. The residue entrance 224 is formed on a top surface of the protrusion body 221, which is exactly located below the punching head module 130 to be aligned with the punching head module 130, and in communication with the discharge zone passage 222. The air passage 101 is disposed in the indexing plate stand 300 and the baseplate 100, so as to be in communication with the discharge zone passage 222. Thus, when the workpiece 20 is punched, waste material P generated from the workpiece 20 falls into the discharge zone passage 222 through the residue entrance 224, and then is discharged outwards from the punching mold device 10 through the air passage 101.

As shown in FIG. 2A and FIG. 4, for example, the punching head module 130 includes punching dies 131. The punching dies 131 are spaced from each other. The clamping portion 220 further includes a punch insert 226. The punch insert 226 is located within the residue entrance 224 and a recess 211 of the stationary module 210. The punch insert 226 has discharge holes 227. The discharge holes 227 are arranged corresponding to the punching dies 131. Therefore, when the workpiece 20 is hung onto the protrusion body 221, the workpiece 20 is located between the punch insert 226 and the punching head module 130. Each time when the punching head module 130 punches one part of the peripheral surface (e.g., the circumferential surface 21 of the round column cover) of the workpiece 20, the punching dies 131 of the punching head module 130 pass through the workpiece 20 and the discharge holes 227 of the punch insert 226, such that the punching dies 131 respectively produce plural punch holes 24 on the part of the peripheral surface (e.g., the circumferential surface 21 of the round column cover) of the workpiece 20 at each punching. In the present disclosure, the punched hole is not limited to a through hole or a blind hole.

Figure 5A:
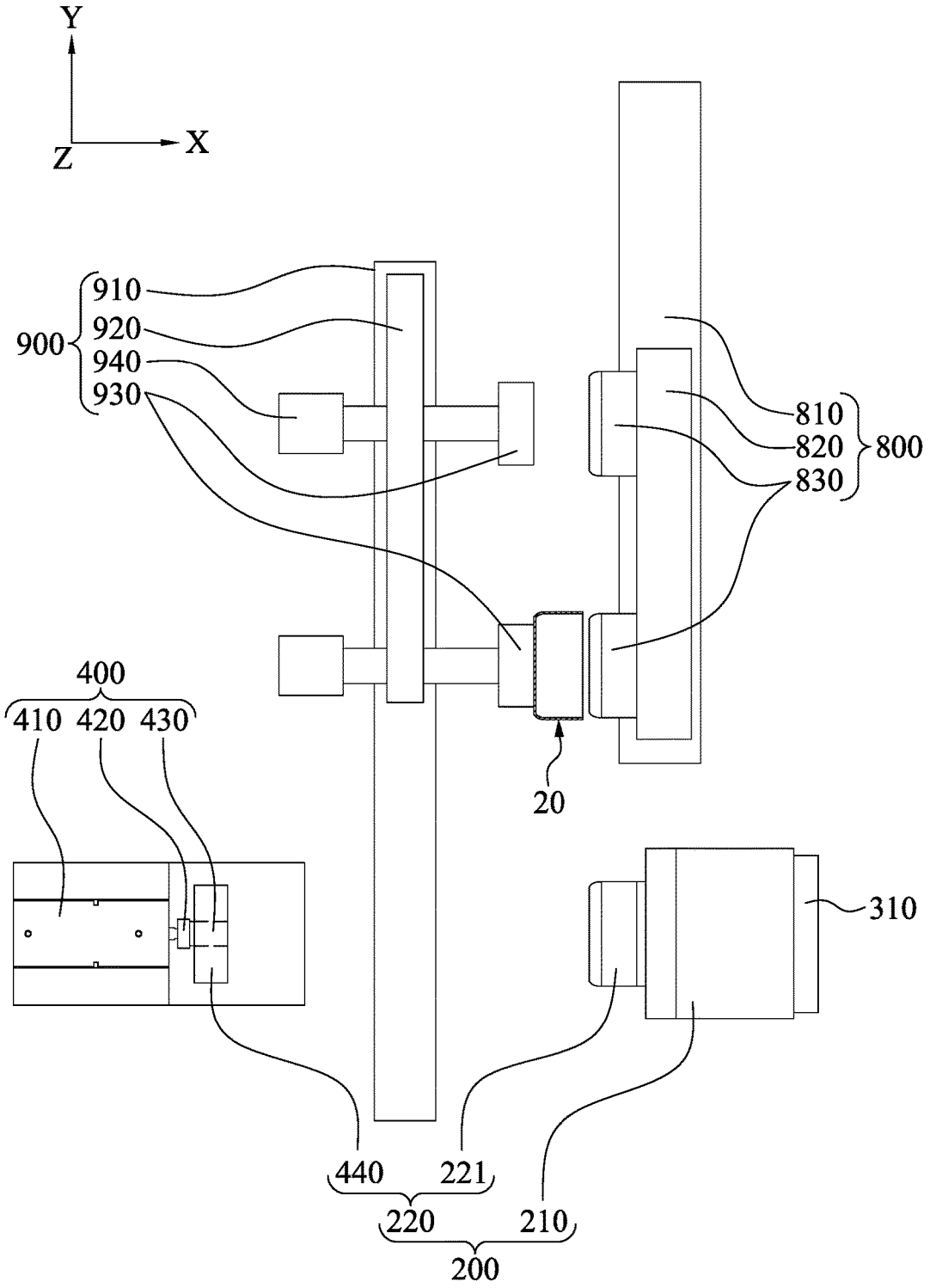
FIGS. 5A and 5B are structural schematic views of a first transportation device and a second transportation device of the punching mold device of FIG. 1.
Figure 5B:
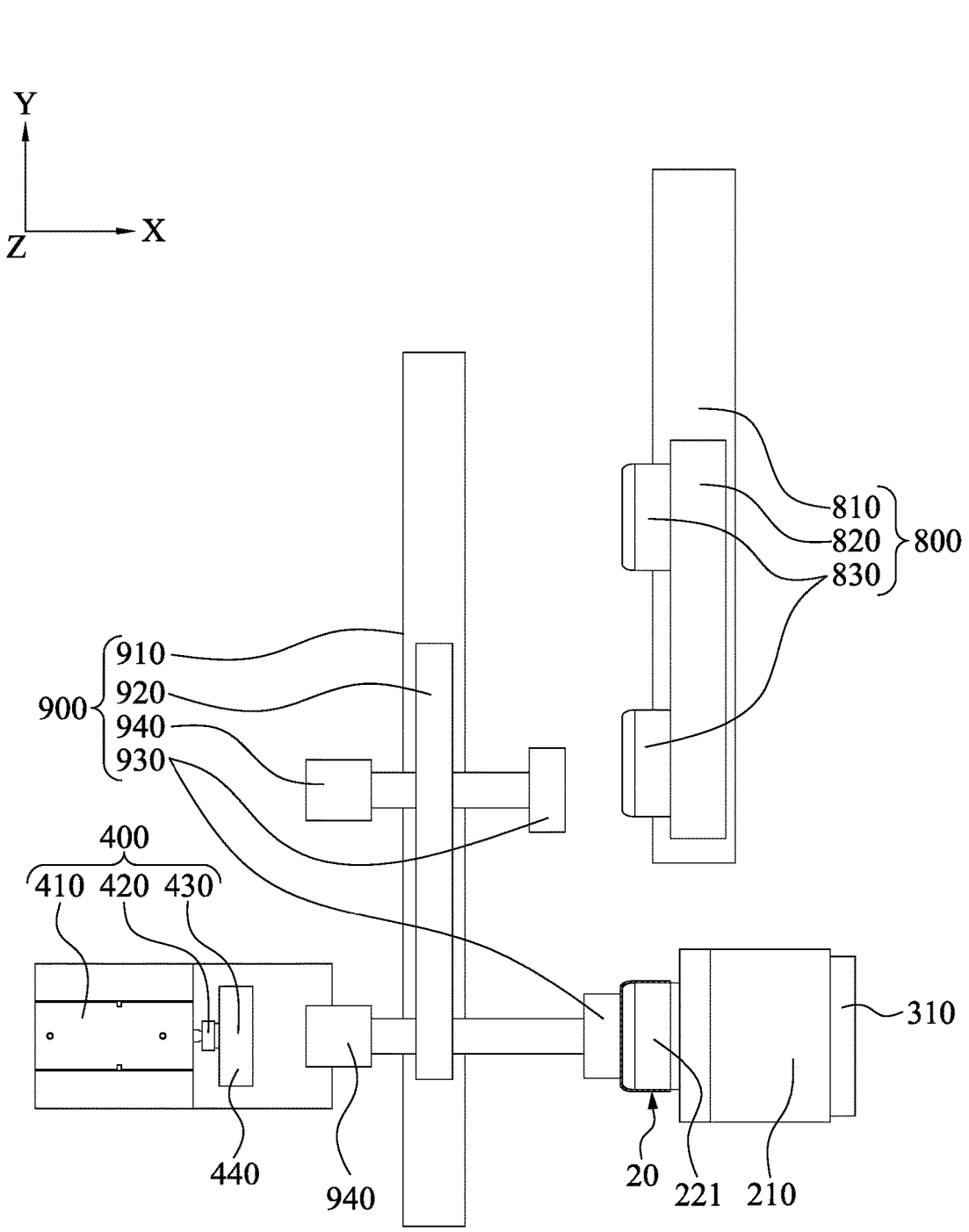

FIGS. 5A and 5B are structural schematic views of a first transportation device 800 and a second transportation device 900 of the punching mold device 10 of FIG. 1. As shown in FIG. 5A and FIG. 5B, the punching mold device 10 includes a first transportation device 800 and a second transportation device 900. The first transportation device 800 includes a first linear sliding rail 810, a first moving carrier 820 and two first vacuum suction cups 830. The first linear sliding rail 810 linearly extends along an axial direction (e.g., Y axis). The first moving carrier 820 is slidably disposed on the first linear sliding rail 810, such that the first moving carrier 820 can be reciprocated on the first linear sliding rail 810. The first moving carrier 820 is connected to both of the first vacuum suction cups 830, so as to move the first vacuum suction cups 830 on the first linear sliding rail 810. Thus, each of the first vacuum suction cups 830 can be moved to reach a material trough (not shown in figures) and obtain a workpiece 20 from the material trough.

The second transportation device 900 includes a second linear sliding rail 910, a second moving carrier 920, two second vacuum suction cups 930 and two suction-cup driving cylinders 940. The second linear sliding rail 910 linearly extends along the axial direction (e.g., Y axis), and is disposed between the mandrel 440 and the clamping portion 220, and is parallel to the first linear sliding rail 810. The second moving carrier 920 is slidably disposed on the second linear sliding rail 910, such that the second moving carrier 920 can be reciprocated on the second linear sliding rail 910. The second vacuum suction cups 930 and the suction-cup driving cylinders 940 are respectively disposed on the second moving carrier 920, such that the second moving carrier 920 can move the second vacuum suction cups 930 and the suction-cup driving cylinders 940 on the second linear sliding rail 910. Each of the suction-cup driving cylinders 940 is connected to one of the second vacuum suction cups 930 so as to move the second vacuum suction cup 930 to one of the first vacuum suction cups 830, and the second vacuum suction cup 930 can take over the workpiece 20 from the first vacuum suction cup 830. Also, each of the suction-cup driving cylinders 940 also can move the second vacuum suction cups 930 to the position of the clamping portion 220, such that the second vacuum suction cup 930 can place the workpiece 20 onto the clamping portion 220, or remove the workpiece 20 away from the clamping portion 220.

Figure 6:
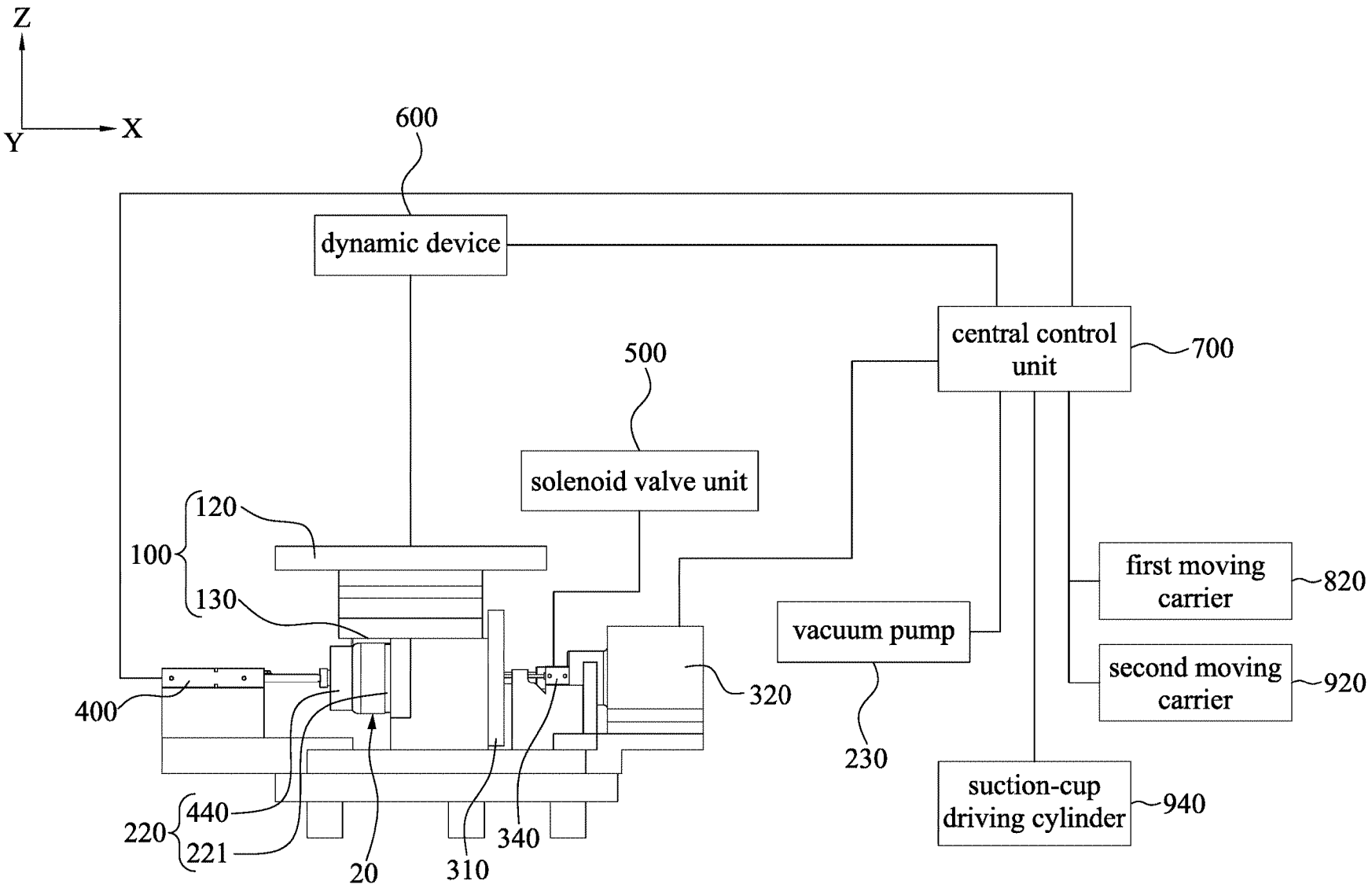
FIG. 6 is a component relationship diagram of the punching mold device of FIG. 1.

FIG. 6 is a component relationship diagram of the punching mold device 10 of FIG. 1. As shown in FIG. 1 and FIG. 6, the punching mold device 10 further includes a solenoid valve unit 500, a dynamic device 600, a vacuum pump 230 and a central control unit 700. The solenoid valve unit 500 is disposed outside the baseplate 100. The solenoid valve unit 500 is connected to the positioning pin 341, and is used to periodically drive the positioning pin 341 to be inserted into or unplugged from one of the holes 311 in an axial direction (e.g., X-axis) repeatedly. The dynamic device 600 is disposed outside the baseplate 100, and is connected to the pressing board 120, and is used to move the punching head module 130 to be reciprocated in an axial direction (e.g., Z-axis), such that the punching head module 130 can be moved to the workpiece 20 to punch the workpiece 20. The vacuum pump 230 is disposed outside the baseplate 100, and is in communication with the discharge zone passage 222 through the air passage 101. Thus, the vacuum pump 230 can suck the waste material P away from the discharge zone passage 222. More specifically, the discharge zone passage 222 further includes an inclined portion 223. The inclined portion 223 is used to guide the waste material P towards the air passage 101 from the discharge zone passage 222, that is, the inclined portion 223 can guide the waste material P to a position of the discharge zone passage 222 adjacent to the air passage 101, such that the vacuum pump 230 can effectively suck the waste material P out of the discharge zone passage 222 through the air passage 101. The central control unit 700 is disposed outside the baseplate 100, and the central control unit 700 is electrically connected to the dynamic device 600, the servo motor 320, the solenoid valve unit 500, the positioning cylinder 400, the vacuum pump 230, the first moving carrier 820, the second moving carrier 920 and the suction-cup driving cylinders 940. The central control unit 700 controls the servo motor 320 to synchronously rotate the indexing rotation plate 310 and the workpiece 20. The central control unit 700 controls the solenoid valve unit 500 to move the positioning pin 341 to be inserted into the hole 311, or unplugged from the hole 311.

Also, the central control unit 700 controls the dynamic device 600 to move the punching head module 130 towards or away from the workpiece 20. For example, the central control unit 700 only controls the dynamic device 600 to punch the workpiece 20 whenever the workpiece 20 is stopped rotating. However, the present disclosure is not limited thereto. The central control unit 700 controls the vacuum pump 230 to suck the waste material P in the discharge zone passage 222 after the punching head module 130 punches the workpiece 20. Also, the central control unit 700 controls the first moving carrier 820 to move one of the first vacuum suction cups 830, controls the second moving carrier 920 to move one of the second vacuum suction cups 930 and the suction-cup driving cylinder 940 corresponding to the second vacuum suction cup 930, and controls the corresponding suction-cup driving cylinder 940 to stretch or retract the second vacuum suction cup 930.

Furthermore, the workpiece chuck 323 further has two sensing pins 324 (FIG. 2A). The sensing pins 324 are electrically connected to the central control unit 700. When the workpiece 20 is placed on the clamping portion 220 to press the sensing pins 324, the sensing pins 324 can inform the central control unit 700 that the workpiece 20 has been placed at the right position.

Figure 7:
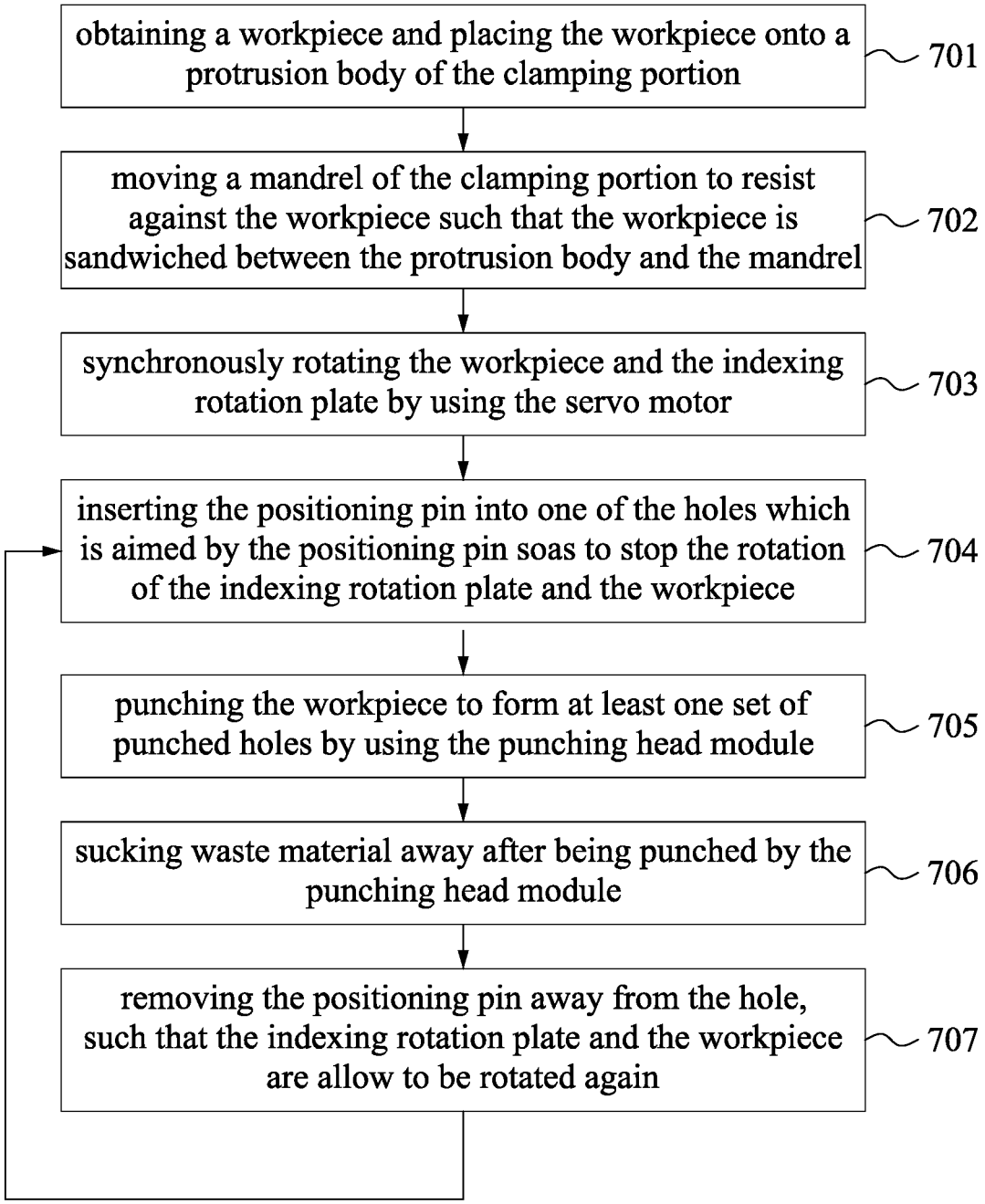
FIG. 7 is a flow chart of a punching method using the punching mold device according to one embodiment of the present disclosure.

FIG. 7 is a flow chart of a punching method using the punching mold device 10 according to one embodiment of the present disclosure. As shown in FIG. 6 and FIG. 7, the punching method using the punching mold device 10 includes Step 701 to Step 707 as follows. In Step 701, a workpiece 20 is obtained, and the workpiece 20 is placed onto the protrusion body 221 of the clamping portion 220. In Step 702, the mandrel 440 of the clamping portion 220 is moved to resist against the workpiece 20, such that the workpiece 20 is sandwiched between the protrusion body 221 and the mandrel 440. In Step 703, the workpiece 20 and the indexing rotation plate 310 are synchronously rotated by using the servo motor 320. In Step 704, the positioning pin 341 is inserted into one of the holes 311 which is aimed by the positioning pin 341, so as to stop the rotation of the indexing rotation plate 310 and the workpiece 20. In Step 705, the workpiece 20 is punched to form at least one set of punched holes 24 by using the punching head module 130. In Step 706, waste material P generated from the workpiece 20 is sucked away after being punched by the punching head module 130. In Step 707, the positioning pin 341 is removed away from the hole 311, such that the indexing rotation plate 310 and the workpiece 20 are allow to be rotated again, and when the positioning pin 341 is aligned with another hole 311 again, Step 704 is returned to perform the loop from Step 704 to Step 707 until the workpiece 20 is completed as a finished product.

Furthermore, in Step 701, more specifically, the aforementioned method further includes some steps as follows. The first moving carrier 820 is controlled by the central control unit 700 to move the first vacuum suction cups 830 to the material trough, such that the workpiece 20 is taken out from the material trough by the first vacuum suction cups 830. Next, the second moving carrier 920 is controlled by the central control unit 700 to move one of the second vacuum suction cups 930 and one of the suction-cup driving cylinders 940, and the second vacuum suction cup 930 is then pushed to the clamping portion 220 by the suction-cup driving cylinder 940, such that the workpiece 20 on the second vacuum suction cup 930 can be placed onto the clamping portion 220. Also, after the workpiece 20 is completed as the finished product on the clamping portion 220, the second vacuum suction cup 930 without carrying anything can be pushed to the clamping portion 220 again by the suction-cup driving cylinder 940 so that the finished product (workpiece) can be taken away from the clamping portion 220 by the second vacuum suction cup 930.

In Step 702, more specifically, the positioning cylinder 400 is controlled by the central control unit 700 to move the mandrel 440 to the workpiece 20, such that the workpiece 20 is sandwiched between the clamping portion 220 and the mandrel 440. For example, the positioning cylinder 400 is controlled by the central control unit 700 to push one surface of the workpiece 20 opposite to the indexing rotation plate 310 according to a predetermined intensity. However, the present disclosure is not limited thereto.

In Step 703, more specifically, the servo motor 320 is controlled by the central control unit 700 to synchronously rotate the indexing rotation plate 310 and the workpiece 20. For example, the servo motor 320 is controlled by the central control unit 700 to synchronously rotate the indexing rotation plate 310 and the workpiece 20 with constant speed. However, the present disclosure is not limited thereto.

In Step 704, more specifically, the solenoid valve unit 500 is controlled by the central control unit 700 to move the positioning pin 341 to insert into one of the holes 311 aimed by the positioning pin 341. For example, the solenoid valve unit 500 is controlled by the central control unit 700 to move the positioning pin 341 to insert into one of the holes 311 aimed by the positioning pin 341 according to a predetermined time point. However, the present disclosure is not limited thereto.

In Step 705, more specifically, the dynamic device 600 is controlled by the central control unit 700 to move the punching head module 130 to the workpiece 20 so that the punching head module 130 punches to produce the punch holes 24 on the workpiece 20. For example, the dynamic device 600 is controlled by the central control unit 700 to move the punching head module 130 to punch the workpiece 20 according to the predetermined time point. However, the present disclosure is not limited thereto.

In Step 706, more specifically, after the workpiece 20 is punched by the punching head module 130, the vacuum pump 230 is controlled by the central control unit 700 to suck the waste material P away from the discharge zone passage 222. For example, the vacuum pump 230 is controlled by the central control unit 700 to suck the waste material P away from the discharge zone passage 222 according to a predetermined negative pressure value. However, the present disclosure is not limited thereto.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of this disclosure provided they fall within the scope of the following claims and their equivalents.

What is claimed is:

1. A punching mold device capable of rotating a workpiece, the punching mold device comprising:
- a lower mold base comprising a clamping portion for fixedly clamping the workpiece;
- an indexing rotation plate which is coaxial to the workpiece and formed with a plurality of holes which collectively form a circular contour;
- a servo motor connected to the indexing rotation plate and the workpiece for synchronously rotating the indexing rotation plate and the workpiece;
- a position-fixing element comprising a positioning pin pluggably connected to one of the holes for stopping a rotation of the indexing rotation plate and the workpiece; and
- an upper mold base disposed opposite to the lower mold base, the upper mold base comprising a punching head module aligned with the clamping portion for punching the workpiece; and
- a solenoid valve connected to the positioning pin for repeatedly moving the positioning pin,
- a central control unit electrically connected to the servo motor and the solenoid valve,
- wherein the solenoid valve is configured to move the positioning pin to pluggably insert into the one of the holes.

2. The punching mold device of claim 1, wherein the clamping portion comprises:
- a mandrel which is movable to press against the workpiece; and
- a protrusion body disposed between the mandrel and the indexing rotation plate such that the workpiece is sandwiched and positioned between the mandrel and the protrusion body.

3. The punching mold device of claim 2, further comprising:
- a positioning cylinder comprising a cylinder body and a telescoping arm telescopically connected the cylinder body; and
- a rotating portion rotatably connected to one end of the telescoping arm opposite to the cylinder body, and jointed to the mandrel,
- wherein, when the cylinder body pushes the telescoping arm forwardly, the mandrel directly contacts and presses against the workpiece so that the mandrel is able to be rotated synchronously with the workpiece.

4. The punching mold device of claim 2, wherein the clamping portion comprises:
- a discharge zone passage disposed inside the protrusion body; and
- a residue entrance formed on a surface of the protrusion body, and located below the punching head module, wherein, when the workpiece is punched by the punching head module, waste material generated from the workpiece fall into the discharge zone passage through the residue entrance.

5. The punching mold device of claim 4, further comprising:

a vacuum pump for sucking the waste material out of the discharge zone passage; and an air passage connected to the discharge zone passage and the vacuum pump.

6. The punching mold device of claim 5, wherein the discharge zone passage comprises an inclined portion for guiding the waste material towards the air passage from the discharge zone passage.

7. The punching mold device of claim 1, wherein the indexing rotation plate is formed with a non-circular through hole thereon; and the servo motor comprises a motor machine, a transmission shaft and a workpiece chuck, one end of the transmission shaft is connected to the motor machine, the other end of the transmission shaft is connected to the workpiece chuck, and the transmission shaft passes through the non-circular through hole of the indexing rotation plate so as to collectively rotate with the indexing rotation plate, and the workpiece chuck passes through the clamping portion to directly prop the workpiece so that the chuck is able to rotate with the workpiece collectively.

8. A punching method applied on the punching mold device of claim 1, the punching method comprising:

(a) placing the workpiece onto the clamping portion;

(b) synchronously rotating the workpiece and the indexing rotation plate by using the servo motor;

(c) using the solenoid valve to move the positioning pin to insert into the one of the holes which is aligned with the positioning pin to stop a rotation of the indexing rotation plate and the workpiece;

(d) punching the workpiece to form at least one set of punched holes by using the punching head module;

(e) using the solenoid valve to remove the positioning pin away from the one of the holes, such that the indexing rotation plate and the workpiece are allowed to be rotated again; and (f) returning to step (c) when the positioning pin is aligned with another of the holes again.

9. The punching method of claim 8, wherein the clamping portion comprises a mandrel and a protrusion body arranged opposite to the mandrel, the mandrel is located at one surface of the workpiece opposite to the protrusion body, and step (a) further comprises:

placing the workpiece on the protrusion body of the clamping portion; and the punching method further comprising:

between step (a) and step (b), pushing the mandrel forwardly to press against the workpiece such that the workpiece is sandwiched between the protrusion body and the mandrel.

10. A punching mold device capable of rotating a workpiece, the punching mold device comprising:

a clamping portion for fixedly clamping the workpiece;

an indexing rotation plate which is coaxial to the workpiece and formed with a plurality of holes which collectively arrange in a circular contour;

a servo motor connected to the indexing rotation plate and the workpiece, for synchronously rotating the indexing rotation plate and the workpiece;

a position-fixing element comprising a positioning pin which is pluggably connected to one of the holes for stopping a rotation of the indexing rotation plate and the workpiece;

a solenoid valve connected to the positioning pin for reciprocating the positioning pin;

a central control unit electrically connected to the servo motor and the solenoid valve; and a punching head module aligned with the clamping portion;

wherein the servo motor is configured to synchronously rotate the indexing rotation plate and the workpiece such that, (a) the solenoid valve is configured to insert the positioning pin into the one of the holes; (b) the punching head module is moved to punch the workpiece; (c) the solenoid valve is further configured to remove the positioning pin from the one of the holes so as to allow the indexing rotation plate and the workpiece to be rotatable again, (d) and steps (a), (b) and (c) are repeated until the workpiece is completed.

11. The punching mold device of claim 10, wherein the clamping portion comprises:

a mandrel which is movable to press against the workpiece; and a protrusion body arranged opposite to the mandrel, for placing the workpiece, wherein the protrusion body is disposed between the mandrel and the indexing rotation plate, so that the workpiece can be sandwiched to be positioned between the protrusion body and the mandrel.

12. The punching mold device of claim 11, further comprising:

a positioning cylinder comprising a cylinder body and a telescoping arm telescopically connected the cylinder body; and a rotating portion rotatably connected to one end of the telescoping arm opposite to the cylinder body, and the mandrel is rotatably jointed to the rotating portion, wherein, before the punching head module punches the workpiece, the cylinder body is configured to push the telescoping arm forwardly, so as to move the mandrel to directly contact and press against the workpiece so that the workpiece can be sandwiched to be positioned between the protrusion body and the mandrel.

* * * * *